US005975448A

United States Patent [19]

Gygi

[11] Patent Number: 5,975,448

[45] Date of Patent: Nov. 2, 1999

[54] MILL

[76] Inventor: Martin H. Gygi, Stumelweg, CH-8914 Aeugst am Albis, Switzerland

[21] Appl. No.: 09/113,461

[22] Filed: Jul. 10, 1998

[51] Int. Cl.[6] ..... B02C 19/00

[52] U.S. Cl. ..... 241/245; 241/254; 241/257.1

[58] Field of Search ..... 241/221, 214, 241/239, 254, 257.1, 258, 245

[56] References Cited

U.S. PATENT DOCUMENTS

| | | | |
|---|---|---|---|
| 615,811 | 12/1898 | Cunningham | 241/257.1 |
| 2,303,387 | 12/1942 | Piper . | |
| 4,541,574 | 9/1985 | Gygi . | |
| 4,905,920 | 3/1990 | Siwersson et al. | 241/258 |
| 5,524,840 | 6/1996 | Gygi . | |

FOREIGN PATENT DOCUMENTS

| | | | |
|---|---|---|---|
| 62079 | 3/1891 | Germany | 241/257.1 |
| 277968 | 12/1951 | Switzerland | 241/258 |
| 8706500 | 11/1987 | WIPO . | |

*Primary Examiner*—Mark Rosenbaum
*Attorney, Agent, or Firm*—Ladas & Parry

[57] ABSTRACT

A mill comprises a static frame and a movable frame interconnected by springs. The movable frame carries a milling ring and a motor. The motor is driving a roller for running along the inner side of the milling ring. Material is crushed between the ring and the roller. Mounting the motor to the movable frame simplifies the design of the mill and dampens the oscillating movements of the movable frame.

24 Claims, 2 Drawing Sheets

MILL

BACKGROUND OF THE INVENTION

The invention relates to a mill comprising a milling ring, a roller and a motor for moving the roller within the milling ring. Such mills can e.g. be used for milling stones and other material.

U.S. Pat. No. 5,524,840 describes a mill of this type. It comprises a static frame and a motor arranged on said static frame. A mobile frame is suspended from the static frame. The mobile frame supports the milling ring and the roller. A flexible coupling mechanism is required for coupling the motor to the roller. This leads to a rather complex design prone to failure.

BRIEF SUMMARY OF THE INVENTION

Hence, it is a general object of the invention to provide a mill of the type mentioned above that has a simpler design than known mills.

Now, in order to implement these and still further objects of the invention, which will become more readily apparent as the description proceeds, the mill is manifested by comprising a static frame, a movable frame displaceably held by said static frame, a milling ring mounted to said movable frame, a motor mounted to said movable frame, and a single roller driven by said motor for rolling around in said milling ring.

In another aspect of the invention, the mill comprises a static frame, a movable frame, spring means for elastically mounting said movable frame to said static frame, a milling ring mounted to said movable frame, a motor mounted to said movable frame, a vertical drive shaft driven by said motor, and a single roller tiltably connected to said drive shaft.

In jet another aspect of the invention, the mill comprises a static frame, a movable frame, spring means for elastically mounting said movable frame to said static frame, a milling ring mounted to a first side of said movable frame, a motor mounted to a second side of said movable frame, said second side being opposite said first side, a vertical drive shaft driven by said motor, and a single roller tiltably connected to said drive shaft.

By mounting the motor to the movable frame, the motor can be directly connected to the roller, which simplifies the design of the whole mill.

Preferably, the roller is tiltably mounted to the drive shaft of the motor, which allows to compensate for a wear of roller and ring.

If the roller axle is excentrically mounted on the drive shaft, the change of rotational momentum of the running roller is smaller, thereby reducing undesired torque.

Preferably, the movable frame comprises a base plate and a cylindrical wall extending between the base plate and the ring. The cylindrical wall forms a lateral guide for the material to or from the ring.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
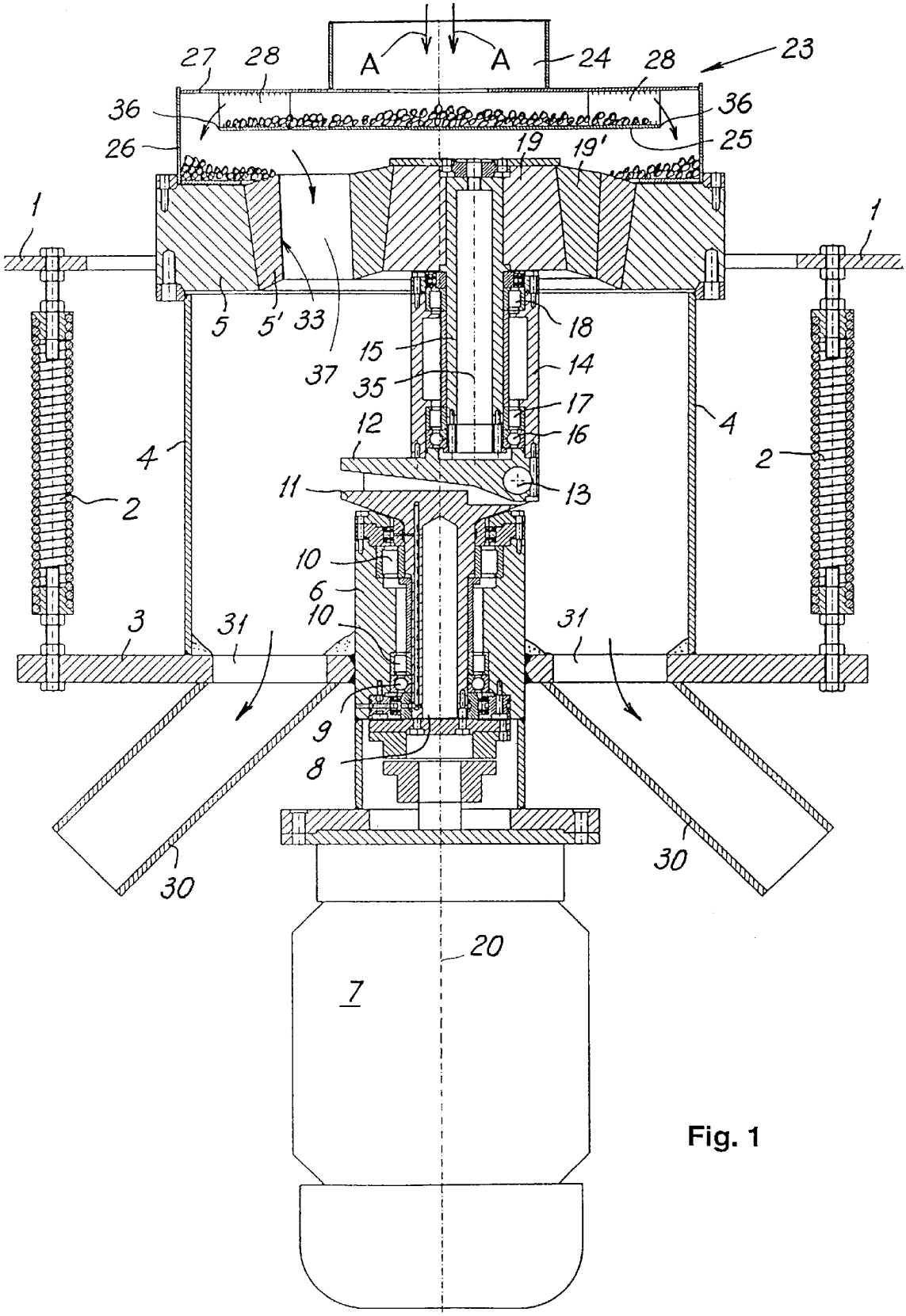
FIG. 1 is a sectional view of a first embodiment of the invention.

The mill shown in FIG. 1 comprises a static frame 1, which can e.g. be mounted to a concrete foundation. A plurality of vertical helical springs 2 are suspended in a circle from static frame 1. The springs 2 carry a movable frame comprising a circular base plate 3. A cylindrical (or conical) wall 4 is welded concentrically to base plate 3 and carries a milling ring 5 with an inner lining 5'.

A vertical drive shaft sleeve 6 is mounted at the center of base plate 3 and carries a motor 7. Motor 7 actuates a drive shaft 8 concentrically held in drive shaft sleeve 6 by means of a ball bearing 9 and roller bearings 10. Drive shaft 8 ends in a joint assembly 11, 12, 13 comprising a lower jaw member 11 and an upper jaw member 12 hingedly connected in a horizontal tilting axis 13.

Upper jaw member 12 is rigidly connected to a roller holder 14.

A roller axle 15 is rotatably arranged within roller holder 14 and held by ball and roller bearings 16, 17, 18. Roller axle 15 is rigidly connected to the center of a single roller 19 with a lining 19'. Roller axle 15 and therefore roller 19 are arranged eccentrically in respect to drive shaft 8 such that a rotation of drive shaft 8 moves roller axle 15 and roller 19 along a substantially circular path around the mill's central axis 20.

Roller holder 14, roller axle 15 and roller 19 can be tilted about tilting axis 13 in respect to drive shaft 8. A tilting movement towards mill axis 20 is limited by upper jaw member 12 abutting against lower jaw member 11, which makes sure that roller 19 is always eccentric to milling axis 20, thereby preventing roller 19 from falling into the center of milling ring 5.

The diameter of roller 19 is at least as large as the radius of the inner opening of milling ring 5. A roller of this size has lower frictional losses and is less easily disturbed in its path by the material to be crushed than a plurality of smaller rollers.

An inlet housing 23 is attached to the top of milling ring 5. It comprises an inlet opening 24, a round distributing table 25, a cylindrical lateral wall 26 and a cover 27. Distributing table 25 is suspended from cover 27 by means of four vertical, radially aligned plates 28, two of which are visible in FIG. 1.

Furthermore, the mill comprises outlet tubes 30, extending outwardly from outlet openings 31 in base plate 3.

The operation of the mill of FIG. 1 is as follows:

Motor 7 rotates drive shaft 8 and roller holder 14 in circular motion about mill axis 20. This circular motion causes roller 19 to roll along the inner surface 33 of milling ring 5. The frequency of this circular motion is equal to the rotation frequency of motor 7.

Depending on the wear of lining 5' of milling ring 5 and roller 19, the axis 35 of roller 19 may be parallel to mill axis 20 or slightly tilted.

Due to the motion of roller 19, the movable frame, base plate 3, motor 7 and milling ring 5 will oscillate, which supports a regular distribution of the material to be milled. Because heavy motor 7 and milling ring 5 are arranged on opposite sides of base plate 3, the center of oscillation lies approximately in the center of the motor. This effect is enhanced by the height of circular wall 4, which keeps milling ring 5 at a distance from base plate 3.

Material to be milled enters the mill as shown with arrows A. It hits distributing table 25 and falls off its outer edge 36 onto milling ring 5. From there, it enters the gap 37 between milling ring 5 and roller 19, where it is crushed. The crushed material falls onto base plate 3 and leaves the mill through openings 31 and tubes 30.

Figure 2:
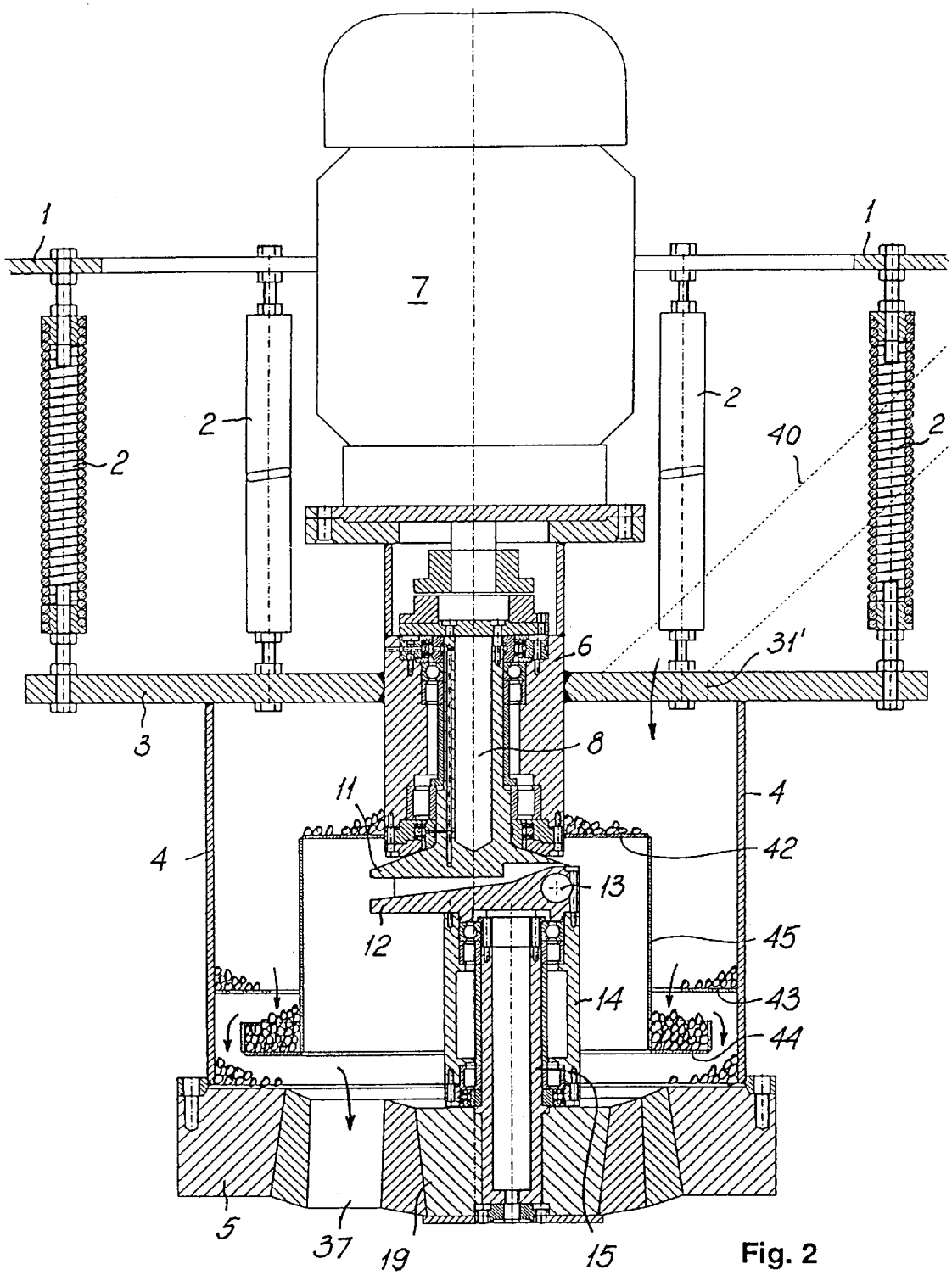
FIG. 2 is a sectional view of a second embodiment of the invention.

FIG. 2 shows an alternative embodiment of a mill according to the present invention. Again, the mill comprises a static frame 1, springs 2 suspending therefrom and holding a movable frame. The movable frame comprises a base plate 3. A cylindrical wall 4 is welded to and suspended from base plate 3, holding the milling ring 5.

The design of drive shaft sleeve 6, motor 7, drive shaft 8, joint assembly 11, 12, 13, roller holder 14, roller axle 15 and roller 19 corresponds to the one the embodiment of FIG. 1 but is turned upside down, i.e. motor 7 is located above base plate 3 and roller 19 below it.

An inlet pipe 40 is provided to guide the material to be milled to an inlet opening 31' in base plate 3, from where it falls onto a distributing table 42, which is welded to drive shaft sleeve 6. From there it continues to a first circumferential ledge 43 attached to cylindrical wall 4, a second circumferential ledge 44 and milling ring 5. It then enters the gap 37 between milling ring 5 and roller 19 to be crushed. An inner cylindrical wall 45, which extends downward from distributing table 42, protects joint assembly 11, 12, 13 from the incoming material.

The design of FIG. 2 has the advantage that the material is crushed in the bottom most section of the mill, from where it can leave immediately. This reduces the risk of clogging the mill with milled material.

Both embodiments discussed so far have the advantage of a simple design, combining it with the advantages of single roller type mill as disclosed in U.S. Pat. No. 5,524,840. Since the milling ring as well as the motor are rigidly mounted to the movable frame, linking roller and motor becomes easy, while the weight of the motor tends to dampen the movements of the movable frame.

While there are shown and described presently preferred embodiments of the invention, it is to be distinctly understood that the invention is not limited thereto but may be otherwise variously embodied and practised within the scope of the following claims.

What is claimed is:

1. A mill comprising:

a static frame, a movable frame displaceably held by said static frame, a milling ring fixedly mounted on said movable frame, a motor mounted on said movable frame, and a single roller in contact with said milling ring and driven by said motor for rolling on an inner surface of said milling ring to crush material introduced between the roller and the ring, said movable frame, said motor, said milling ring and said roller forming an assembly which is movable relative to said static frame during drive of the motor and crushing of the material.

2. The mill of claim 1 further comprising a drive shaft driven by said motor for rotation around a drive shaft axis, a roller holder mounted to said drive shaft and being tiltable about a tilting axis substantially perpendicular to said drive shaft, and a roller axle rotatably held by said roller holder and holding said roller.

3. The mill of claim 2, wherein said drive shaft is substantially vertical.

4. The mill of claim 2, wherein said roller axle is eccentrically mounted in respect to said drive shaft.

5. The mill of claim 4 further comprising a joint assembly for tiltably connecting said drive shaft and said roller holder, wherein said joint assembly comprises means for limiting movement of said roller towards a center of said milling ring.

6. The mill of claim 1 further comprising spring means for elastically mounting said movable frame on said static frame.

7. The mill of claim 6, wherein said movable frame comprises a base plate mounted on said spring means.

8. The mill of claim 7, wherein said movable frame comprises a substantially cylindrical wall extending between said base plate and said milling ring.

9. The mill of claim 8, wherein said base plate comprises passage openings.

10. The mill of claim 9, further comprising guiding means for guiding material to and from said passage openings.

11. The mill of claim 1, wherein said motor is arranged above said milling ring.

12. The mill of claim 1, wherein said motor is arranged below said milling ring.

13. The mill of claim 1, wherein said movable frame is elastically suspended in said static frame.

14. The mill of claim 1, wherein a diameter of said roller is at least as large as an inner radius of said milling ring.

15. The mill of claim 1, wherein said motor has a drive axis and said roller has a rotation axis offset from said drive axis, said mill further comprising a drive connection between the motor and said roller permitting a limited tilting movement of said rotation axis of said roller relative to said drive axis of the motor.

16. The mill of claim 1, wherein said assembly is movable with a tilting movement around a center of oscillation located in proximity to said motor.

17. The mill of claim 1, comprising a distributing plate connected to said movable frame above said milling ring for receiving material to be crushed and distributing said material onto said milling ring for introduction between said milling ring and said roller.

18. The mill of claim 17, comprising discharge tubes connected to said movable frame for discharging the crushed material from the mill.

19. A mill comprising:

a static frame, a movable frame, a spring means for elastically mounting said movable frame on said static frame, a milling ring fixedly mounted on said movable frame, a motor mounted on said movable frame, a vertical drive shaft driven by said motor, and a single roller connected to said drive shaft and being tiltable in respect to said drive shaft about a horizontal tilting axis, said roller being in contact with said milling ring for being driven by said motor to roll on an inner surface of said milling ring to crush material introduced between the roller and the ring, said movable frame, said motor, said milling ring and said roller forming an assembly which is movable relative to said static frame during drive of the motor and crushing of the material.

20. The mill of claim 19, wherein said assembly is movable with a tilting movement around a center of oscillation located in proximity to said motor.

21. The mill of claim 19, comprising a distributing plate connected to said movable frame above said milling ring for receiving material to be crushed and distributing said material onto said milling ring for introduction between said milling ring and said roller.

22. A mill comprising:

a static frame, a movable frame, a spring means for elastically mounting said movable frame on said static frame, a milling ring mounted on a first side of said movable frame, a motor mounted on a second side of said movable frame, said second side being opposite said first side, a vertical drive shaft driven by said motor, and a single roller tiltably connected to said drive shaft, said roller being in contact with said milling ring for being driven by said motor to roll on an inner surface within said milling ring to crush material introduced between the roller and the ring, said movable frame, said motor, said milling ring and said roller forming an assembly which is movable relative to said static frame during drive of the motor and crushing of the material.

23. The mill of claim 22, wherein said assembly is movable with a tilting movement around a center of oscillation located in proximity to said motor.

24. The mill of claim 22, comprising a distributing plate connected to said movable frame above said milling ring for receiving material to be crushed and distributing said material onto said milling ring for introduction between said milling ring and said roller.

* * * * *